US007584641B2

(12) United States Patent
Chang

(10) Patent No.: US 7,584,641 B2
(45) Date of Patent: Sep. 8, 2009

(54) FORGING MACHINE HAVING ROLLERS BETWEEN A SUPPORT AND A SLIDE BODY OF A DIE ASSEMBLY

(75) Inventor: Yun-Te Chang, Tainan (TW)

(73) Assignee: FWU Kuang Enterprises Co., Ltd., Tainan Hsien (TW)

( * ) Notice: Subject to any disclaimer, the term of this patent is extended or adjusted under 35 U.S.C. 154(b) by 642 days.

(21) Appl. No.: 11/390,516

(22) Filed: Mar. 27, 2006

(65) Prior Publication Data

US 2007/0220944 A1 Sep. 27, 2007

(51) Int. Cl.
*B21J 13/04* (2006.01)
*B21D 22/00* (2006.01)
*B21C 1/30* (2006.01)

(52) U.S. Cl. ..... 72/456; 72/455; 72/347; 72/349; 72/361; 470/91

(58) Field of Classification Search ..... 72/344, 72/347, 349, 356, 361, 450, 455, 456; 470/152, 470/153
See application file for complete search history.

(56) References Cited

U.S. PATENT DOCUMENTS 3,696,657 A * 10/1972 Maytag ..... 72/450
4,614,104 A * 9/1986 Straw ..... 72/347
4,866,976 A * 9/1989 Hinterlechner ..... 72/456
5,138,862 A * 8/1992 Chasteen et al. ..... 72/347
5,138,866 A * 8/1992 Hite et al. ..... 72/455
5,263,356 A * 11/1993 Hite et al. ..... 72/456
5,363,686 A * 11/1994 Hite et al. ..... 72/455
5,660,073 A * 8/1997 McBroom et al. ..... 72/337
6,553,806 B1 * 4/2003 Reinert et al. ..... 72/349
6,715,332 B2 * 4/2004 Klingen et al. ..... 72/291
7,021,111 B2 * 4/2006 Chang ..... 72/361

* cited by examiner

*Primary Examiner*—David B Jones
(74) *Attorney, Agent, or Firm*—Trop, Pruner & Hu, P.C.

(57) ABSTRACT

A forging machine includes a support having two sidewalls, and two track plates attached respectively to the sidewalls. A slide body of a die assembly is mounted slidably inside the support between the sidewalls. Two first rolling devices are respectively mounted on the track plates near the front of the support to contact the slide body. Two second rolling devices are mounted respectively on the sidewalls above the track plates and near the rear of the support to contact the slide body. Due to the first and second rolling devices contacting the slide body near the front and rear of the support, the slide body can slide stably in the support without positional deviation.

13 Claims, 16 Drawing Sheets

FORGING MACHINE HAVING ROLLERS BETWEEN A SUPPORT AND A SLIDE BODY OF A DIE ASSEMBLY

BACKGROUND OF THE INVENTION

1. Field of the Invention

The invention relates to a forging machine, more particularly to a forging machine having rollers between a support and a slide body of a male die assembly.

2. Description of the Related Art

Fasteners, such as screws and nuts, are generally manufactured by feeding a wire material into a forging machine. In the forging machine, the wire material is straightened and cut into workpieces that are conveyed to a female die unit, and a male die unit is forced to move to the female die unit to perform a series of forging operations so as to forge the workpieces.

Referring to FIG. 1, a forging machine 1 disclosed in Taiwanese Patent Publication No. 535662 includes a support 11 having a receiving space 111, two rolling devices 12 disposed respectively at left and right sides of the receiving space 111, and a male die assembly 13 installed slidably in the receiving space 111. Each rolling device 12 includes a plurality of rollers 121 in contact with the male die assembly 13 so that the male die assembly 13 can slide smoothly via the rollers 121, and generation of frictional heat during the sliding of the male die assembly 13 can be avoided.

As the forging machine 1 is designed to produce a large number of products within 1 min, the male die assembly 13 has to operate at a high speed. However, since the rolling devices 12 are provided only at the front of the two sides of the support 11 and at the front of the male die assembly 13, during the sliding motion of the male die assembly 13, the rolling movements occur only at the front thereof, and the rear side of the male die assembly 13 is suspended unsupportedly in the receiving space 111. Furthermore, because the length of the male die assembly 13 from a location where it contacts the rollers 121 to its rear end is twice the length from that location to its front end which is assembled with a plurality of punching heads (not shown), in case the male die assembly 13 is tilted slightly, its rear end will vibrate, resulting in positional deviation and reduced stability of the punching heads. As a result, when the male die assembly 13 moves forward to effect forging, particularly, to press the front end punching heads against a female die assembly 14, the male die assembly 13 will strike obliquely the female die assembly 14, thereby adversely affecting the accuracy of the forging operation and the quality of products. Therefore, further improvement relating to the sliding of a male die assembly is desirable.

SUMMARY OF THE INVENTION

Therefore, the main object of the present invention is to provide a forging machine with improvements that is to provide a forging machine with improvements that can overcome the aforementioned drawbacks of the prior art.

According to this invention, a forging machine comprises a support including a bottom wall, two sidewalls extending upward from left and right sides of the bottom wall, and two longitudinal track plates attached to the sidewalls, respectively. Each of the sidewalls has a lower portion to which a corresponding one of the track plates is attached, and an upper portion extending above the lower portion. The bottom wall, the sidewalls, and the track plates cooperatively confine a receiving space.

The forging machine further comprises two first rolling devices respectively mounted on the track plates proximate to a front end of the support, and having first rollers exposed from the track plates, respectively; two second rolling devices respectively mounted on the upper portions proximate to a rear end of the support, and having second rollers exposed from the upper portions, respectively; and a die assembly having a slide body slidably mounted within the receiving space. The slide body includes left and right lower side faces respectively confronting the track plates and contacting the first rollers, and left and right upper flanges that project outwardly and respectively above the left and right lower side faces and that are seated slidably and respectively on top ends of the track plates to contact the second rollers.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
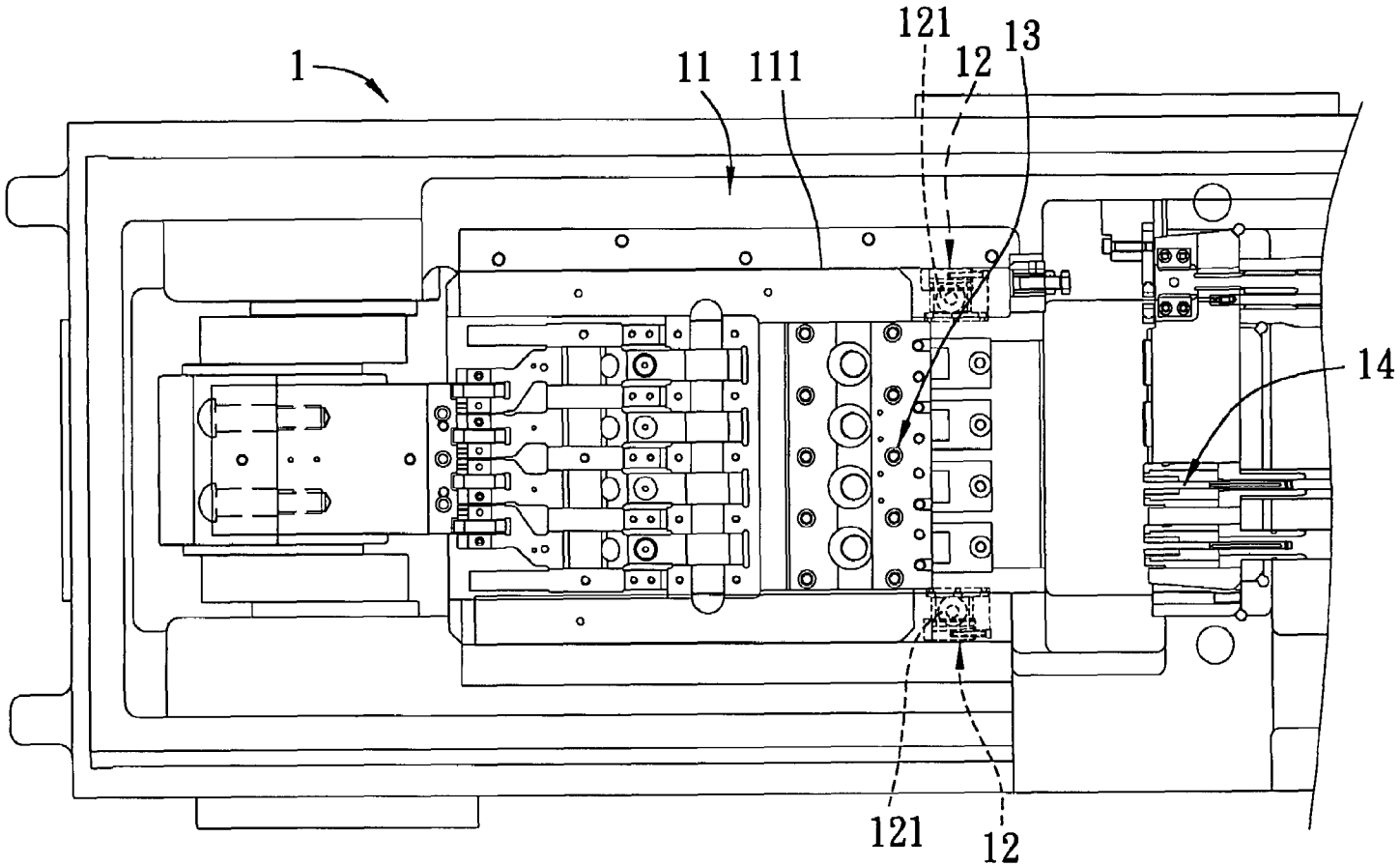
FIG. 1 PRIOR ART
FIG. 1 is a plan view of the prior art.

Before the present invention is described in greater detail, it should be noted that like elements are denoted by the same reference numerals throughout the disclosure.

Figure 2:
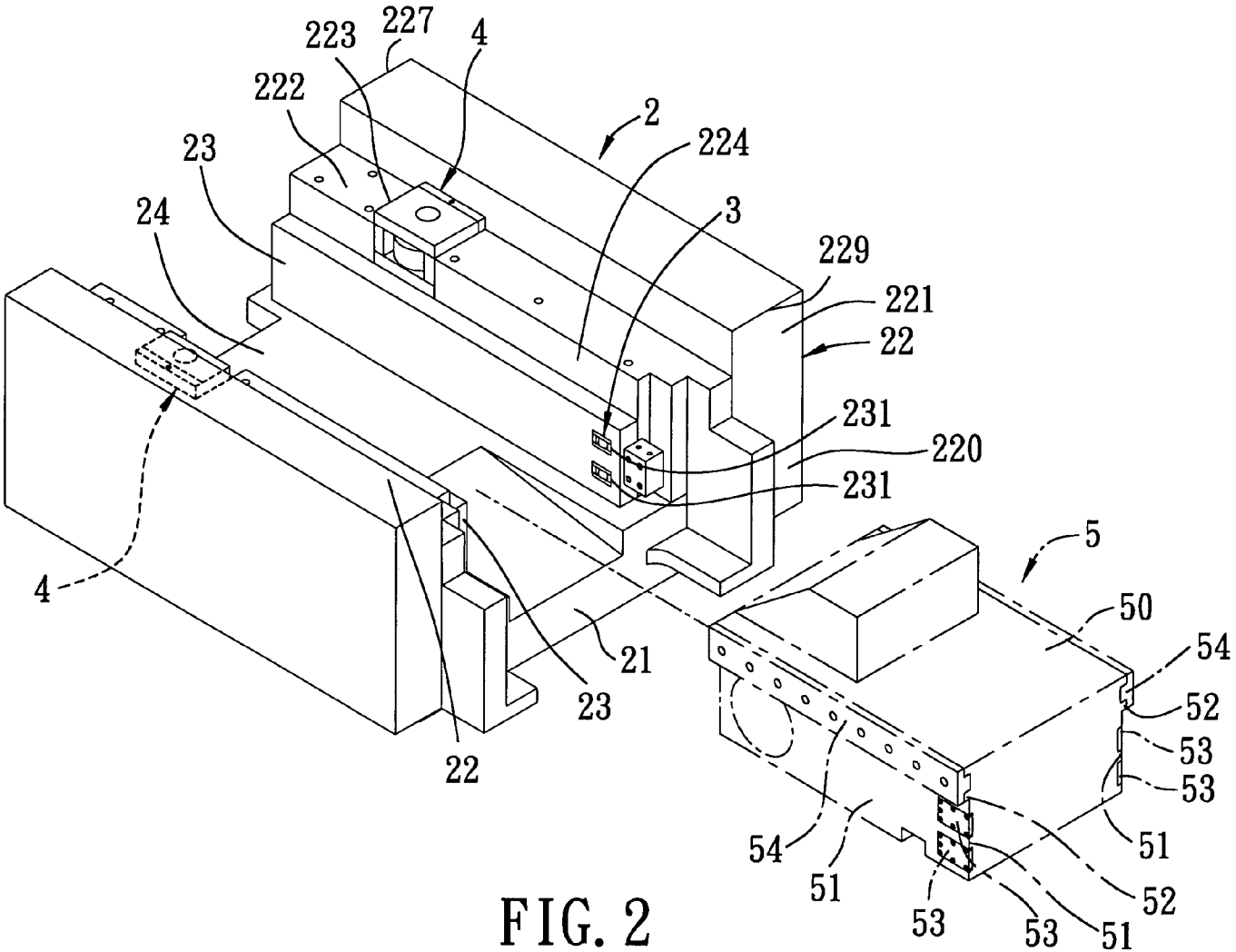
FIG. 2 is an exploded view illustrating a first preferred embodiment of the present invention.
Figure 3:
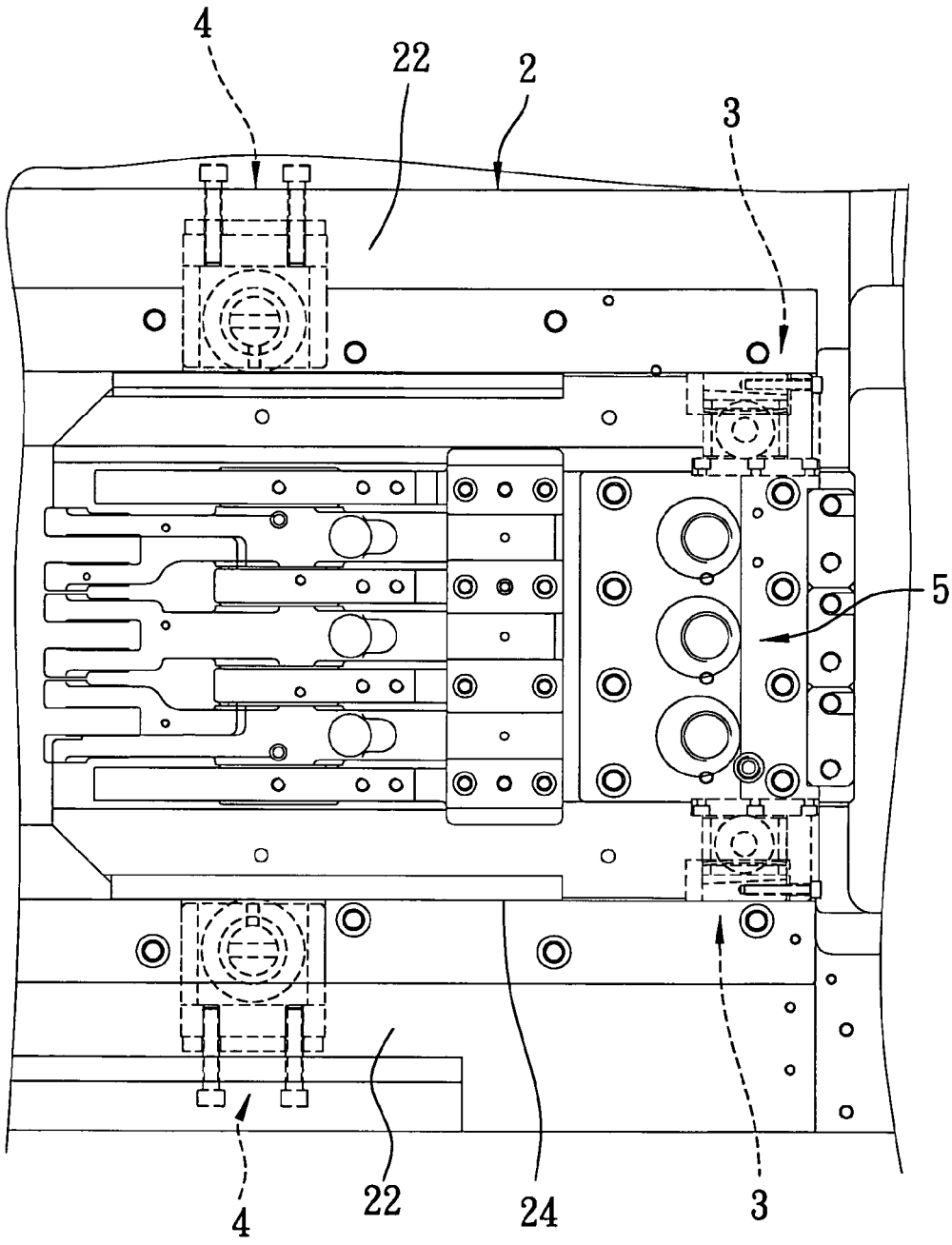
FIG. 3 is a plan view showing the first preferred embodiment.
Figure 4:
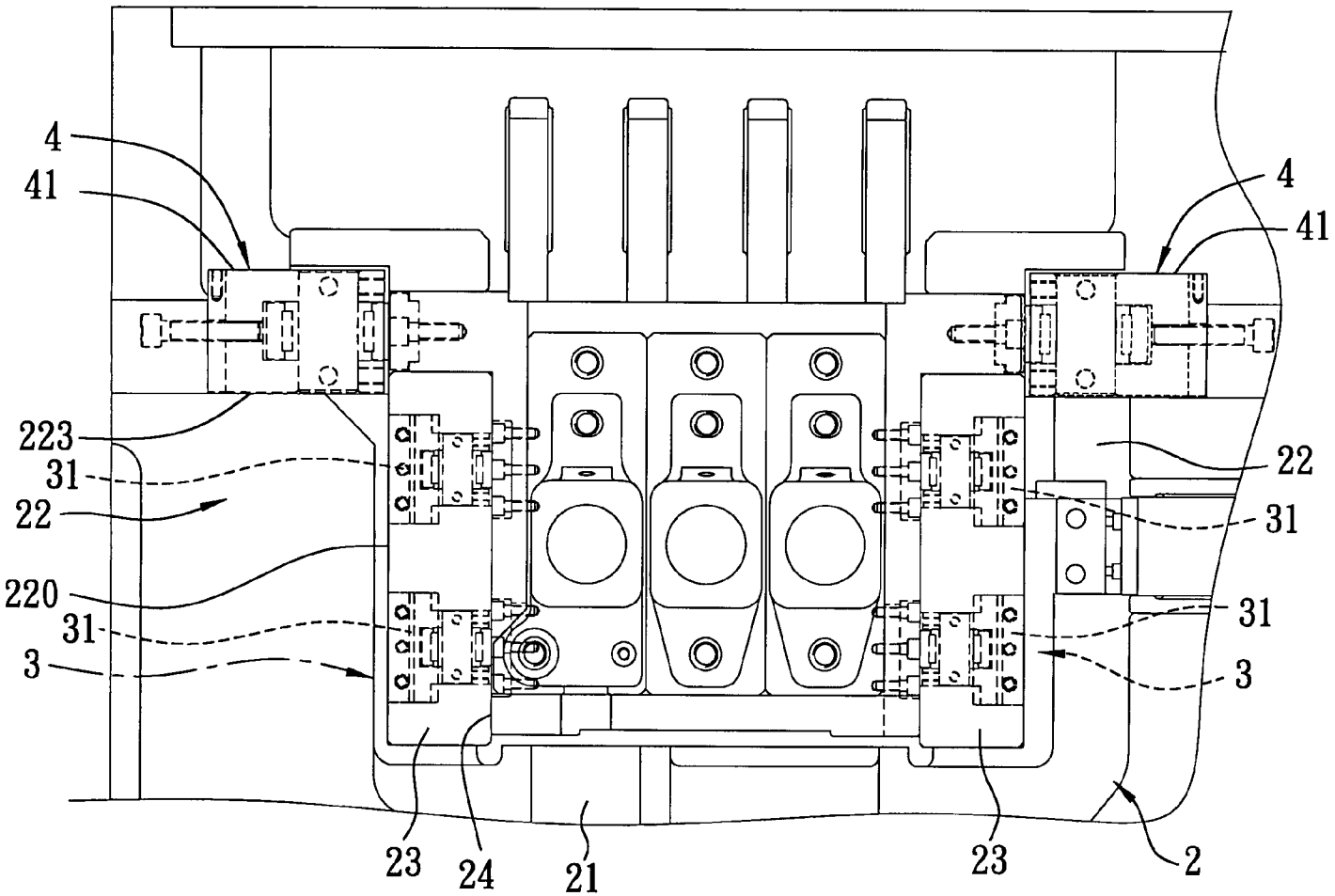
FIG. 4 is an elevation view showing the first preferred embodiment.

Referring to FIGS. 2, 3 and 4, a forging machine according to the present invention includes a support 2, two first rolling devices 3, two second rolling devices 4 and a male die assembly 5.

The support 2 has a bottom wall 21, two sidewalls 22 extending respectively from left and right sides of the bottom wall 21, and two longitudinal track plates 23 mounted respectively on the sidewalls 22 and elongated in a front-to-rear direction. The bottom wall 21, the sidewalls 22 and the track plates 23 cooperatively confine a receiving space 24. Each sidewall 22 has a lower portion 220 to which a corresponding one of the track plate 23 is attached, and an upper portion 221. The upper portion 221 is stepped and thus has a sidewall shoulder face 222 extending horizontally and longitudinally above a top end of the corresponding track plate 23. A sidewall inner face 224 extends vertically and downwardly from the sidewall shoulder face 222 to the top end of the corresponding track plate 23 and faces the receiving space 24. A cavity 223 is formed in the upper portion 221 proximate to a rear end 227 of the support 2, and opens at the sidewall shoulder face 222 and at the sidewall inner face 224. Each track plate 23 has upper and lower through holes 231 proximate to a front end 229 of the support 2.

Figure 5:
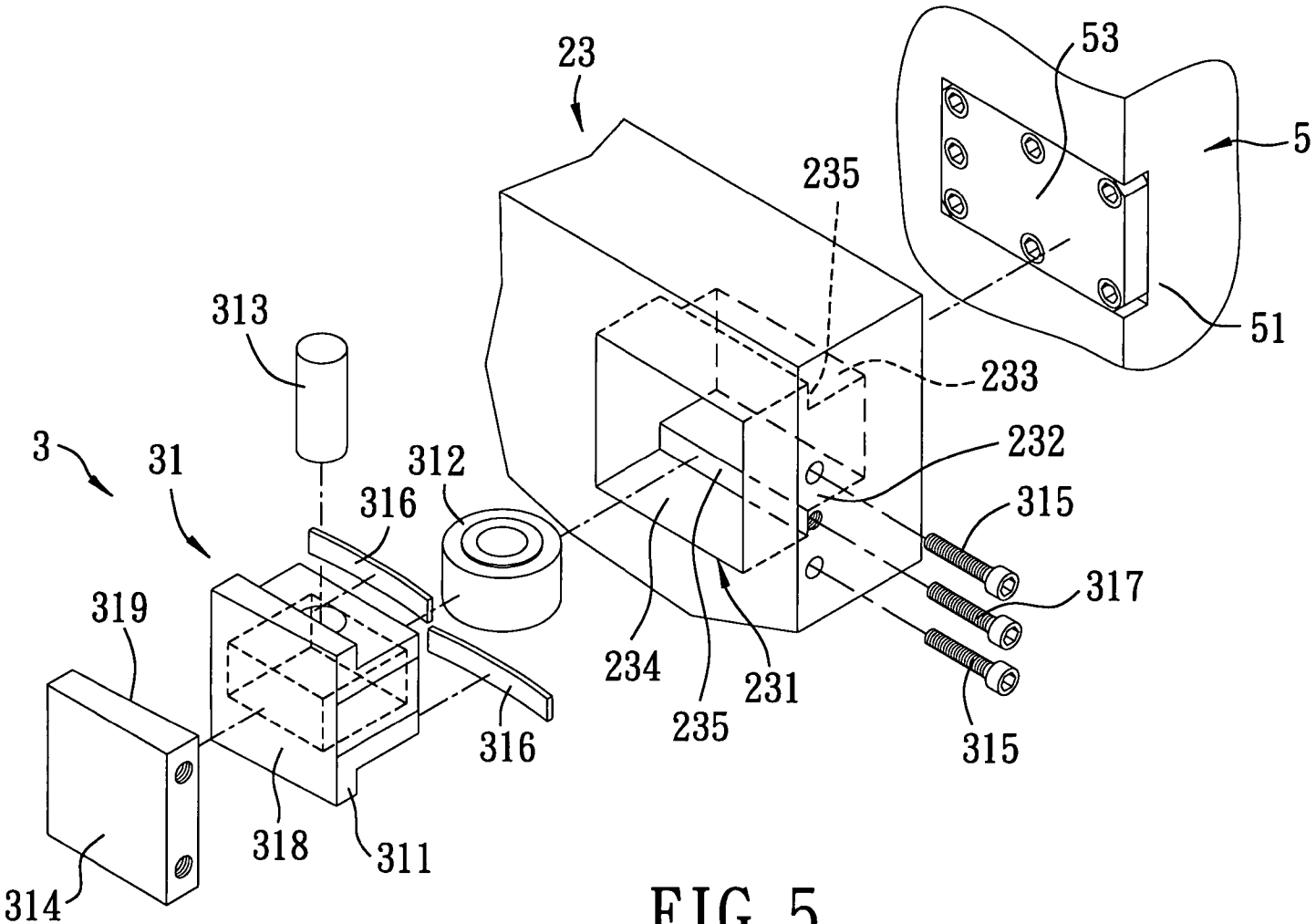
FIG. 5 is an exploded view showing a first rolling device of the first preferred embodiment.
Figure 6:
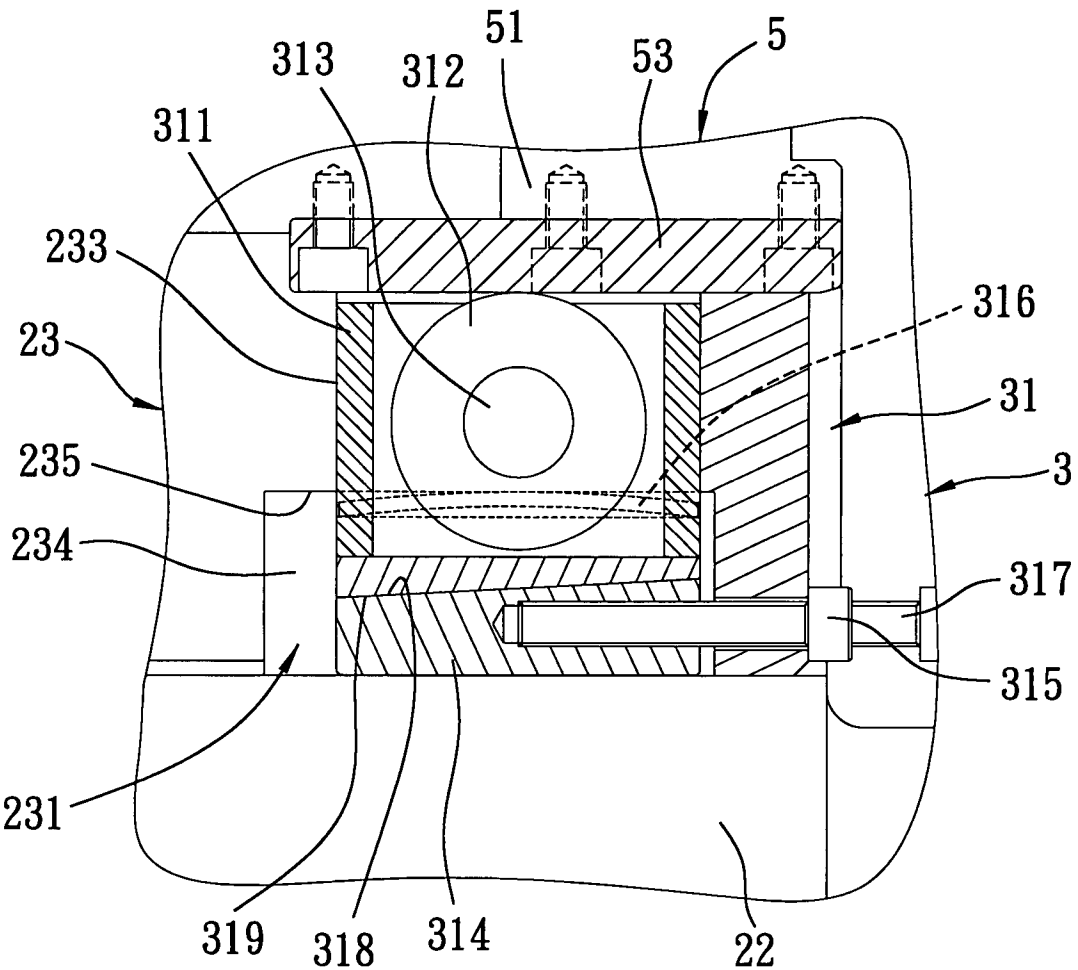
FIG. 6 is a sectional plan view showing the first rolling device of the first preferred embodiment.
Figure 7:
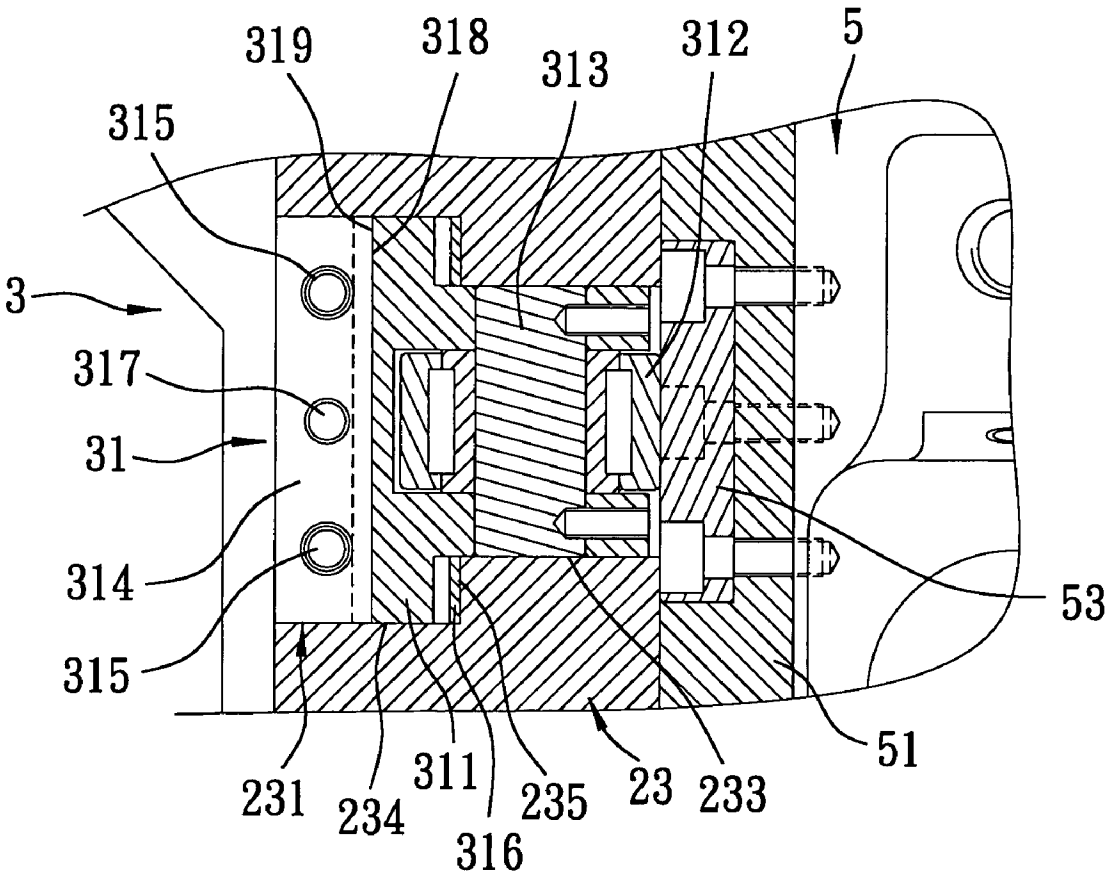
FIG. 7 is a sectional elevation view showing the first rolling device of the first preferred embodiment.

Referring to FIGS. 5, 6 and 7 in combination with FIG. 2, each through hole 231 in each track plate 23 has an inner small hole portion 233, an outer large hole portion 234, and a shoulder 235 formed inside the through hole 231 between the large and small hole portions 234 and 233. The first rolling devices 3 are mounted in the respective track plates 23 on left and right sides of the male die assembly 5. Each first rolling device 3 includes two first roller units 31 mounted respectively within the two through holes 231 in the corresponding track plate 23. Each first roller unit 31 has a first roller holder 311, a first roller 312 disposed inside the first roller holder 311 and exposed from the first roller holder 311 to project into the receiving space 24, a first roller shaft 313 holding pivotally the first roller 312 within the first roller holder 311, a first packing plate 314 disposed between the corresponding track plate 23 and sidewall 22, adjustment screws 315 extending threadedly into the first packing plate 314 through the track plate 23, springs 316 disposed between the first roller holder 311 and the shoulder 235 inside the through hole 231, and a fixing screw 317 extending into the track plate 23 to abut against the first packing plate 314.

The first roller holder 311 has a holder inclined face 318 that is proximate to the first packing plate 314 and that is inclined outwardly. And the first packing plate 314 has a complementary packing inclined face 319 in contact with the holder inclined face 318. Each spring 316 provides a biasing force that biases the first roller holder 311 against the first packing plate 314. The first packing plate 314 can move forward or rearward when the adjustment screws 315 are turned and cooperates with the springs 316 to move the first roller holder 311 outward or inward. When the fixing screw 317 is tightened, it abuts against and immobilizes the first packing plate 314.

Figure 8:
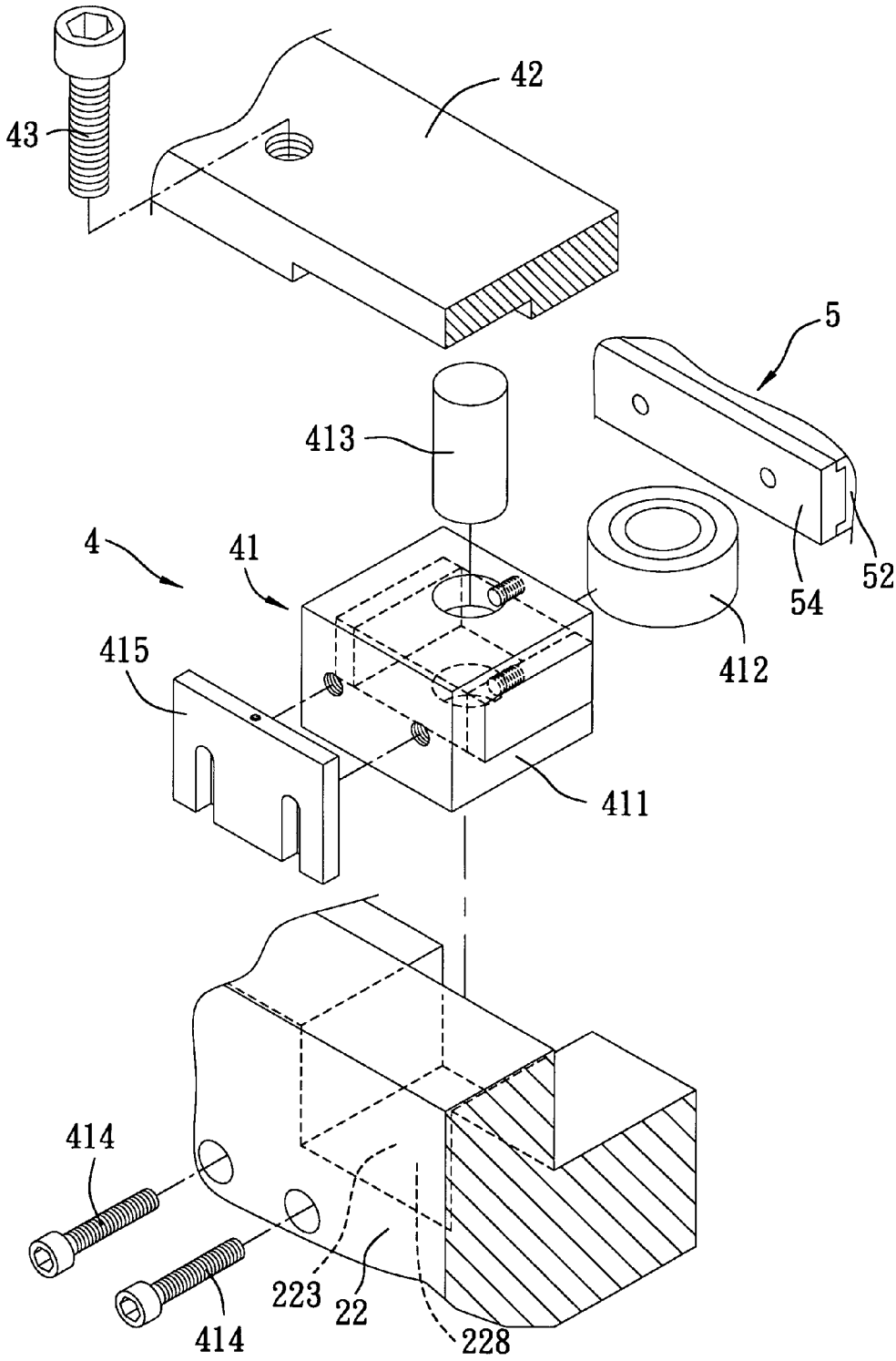
FIG. 8 is an exploded view showing a second rolling device of the first preferred embodiment.
Figure 9:
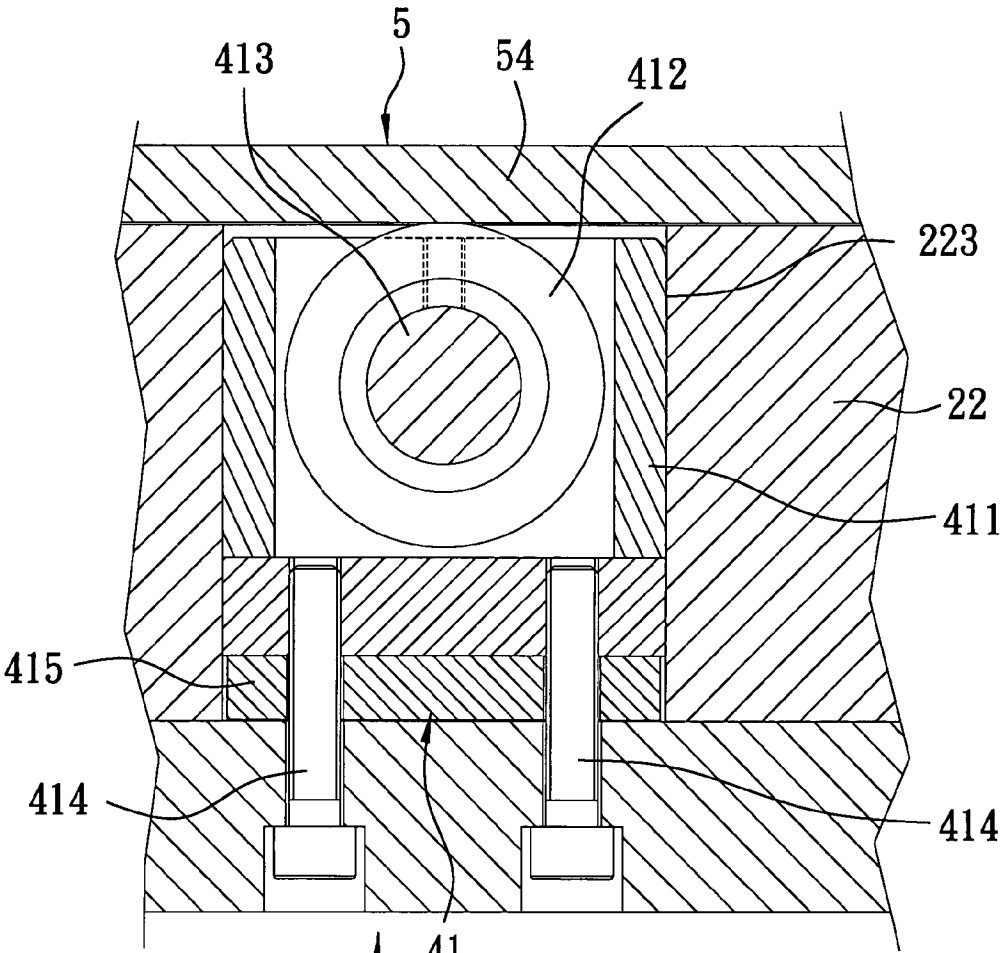
FIG. 9 is a sectional plan view showing the second rolling device of the first preferred embodiment.
Figure 10:
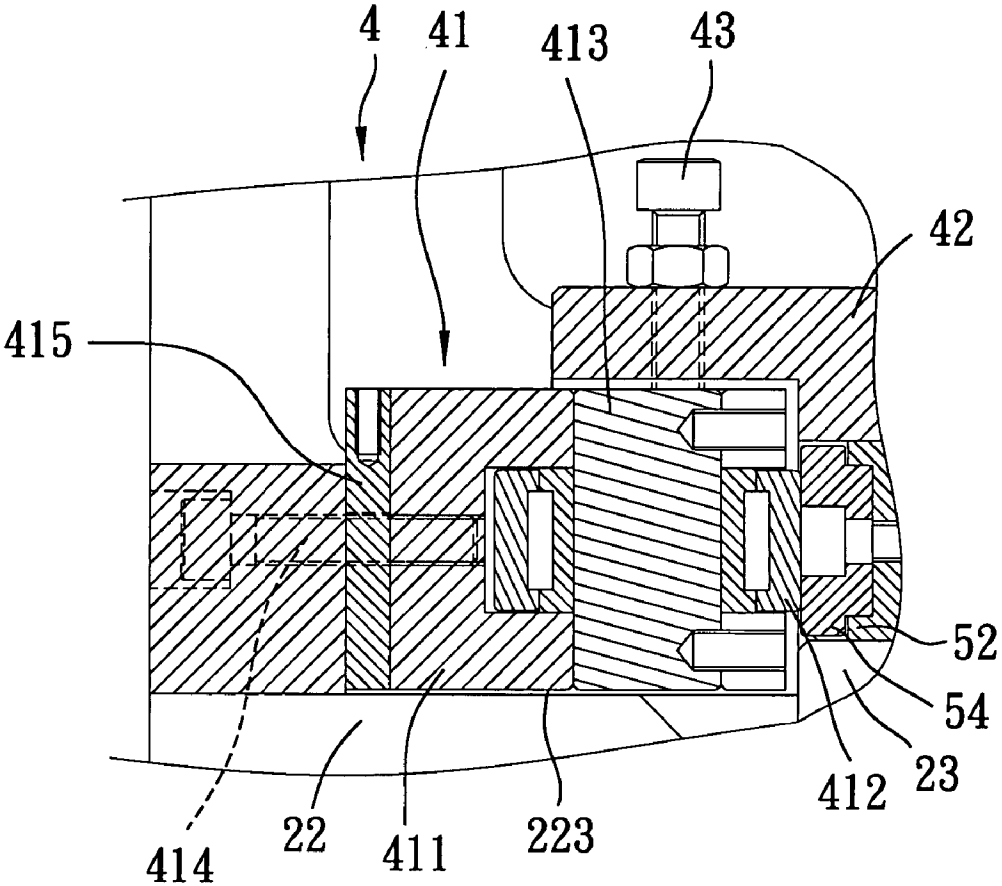
FIG. 10 is a sectional elevation view showing the second rolling device of the first preferred embodiment.

Referring to FIGS. 8, 9 and 10 in combination with FIG. 2, each second rolling device 4 includes a second roller unit 41 having a second roller holder 411 mounted inside the cavity 223 of the respective sidewall 22. The upper portion 221 of the sidewall 22 further has a cavity bounding wall part 228 extending at one side of the second roller holder 411 opposite to the slide body 50. The second roller unit 41 further has a second packing plate 415 inserted in between the cavity bounding wall part 228 and the second roller holder 411, a second roller 412 disposed rotatably inside the second roller holder 411 and exposed from the second roller holder 411 to project into the receiving space 24, a second roller shaft 413 attached to the second roller holder 411 to hold pivotally the second roller 412 within the second roller holder 411, and two fastening bolts 414 extending through the cavity bounding wall part 228 and the second packing plate 415 and inserted threadedly into the second roller holder 411 so as to position the second roller holder 411 inside the cavity 223. A cover plate 42 is disposed over the sidewall shoulder face 222 and the second roller holder 411 and projects into the receiving space 24 so as to extend over the male die assembly 5. The cover plate 42 is fixed to the sidewall shoulder face 222 using a plurality of locking screws 43.

Referring again to FIGS. 2, 7 and 10, the male die assembly 5 has a slide body 50 slidably mounted within the receiving space 24 to move forward or rearward. The slide body 50 includes left and right lower side faces 51 respectively confronting the track plates 23, left and right upper flanges 52 that project outwardly above the respective left and right lower side faces 51 and are seated slidably on the top ends of the track plates, respectively, two pairs of first steel plates 53 each pair of which overlie portions of one of the left and right lower side faces 51, and two second steel plates 54 covering outer surfaces of the respective left and right upper flanges 52. Each of the left and right upper flanges 52 is slidable between the corresponding track plate 23 and the corresponding cover plate 42.

When the slide body 50 is driven to move forward and rearward, the first steel plates 53 are in sliding contact with the respective first rollers 312, and the second steel plates 54 are in sliding contact with the respective second rollers 412. Due to the gapless sliding contact with the first and second rollers 312, 412 near both of the front and rear ends of the support 2, the slide body 50 can be slid smoothly and stably within the receiving space 24.

Figure 11:
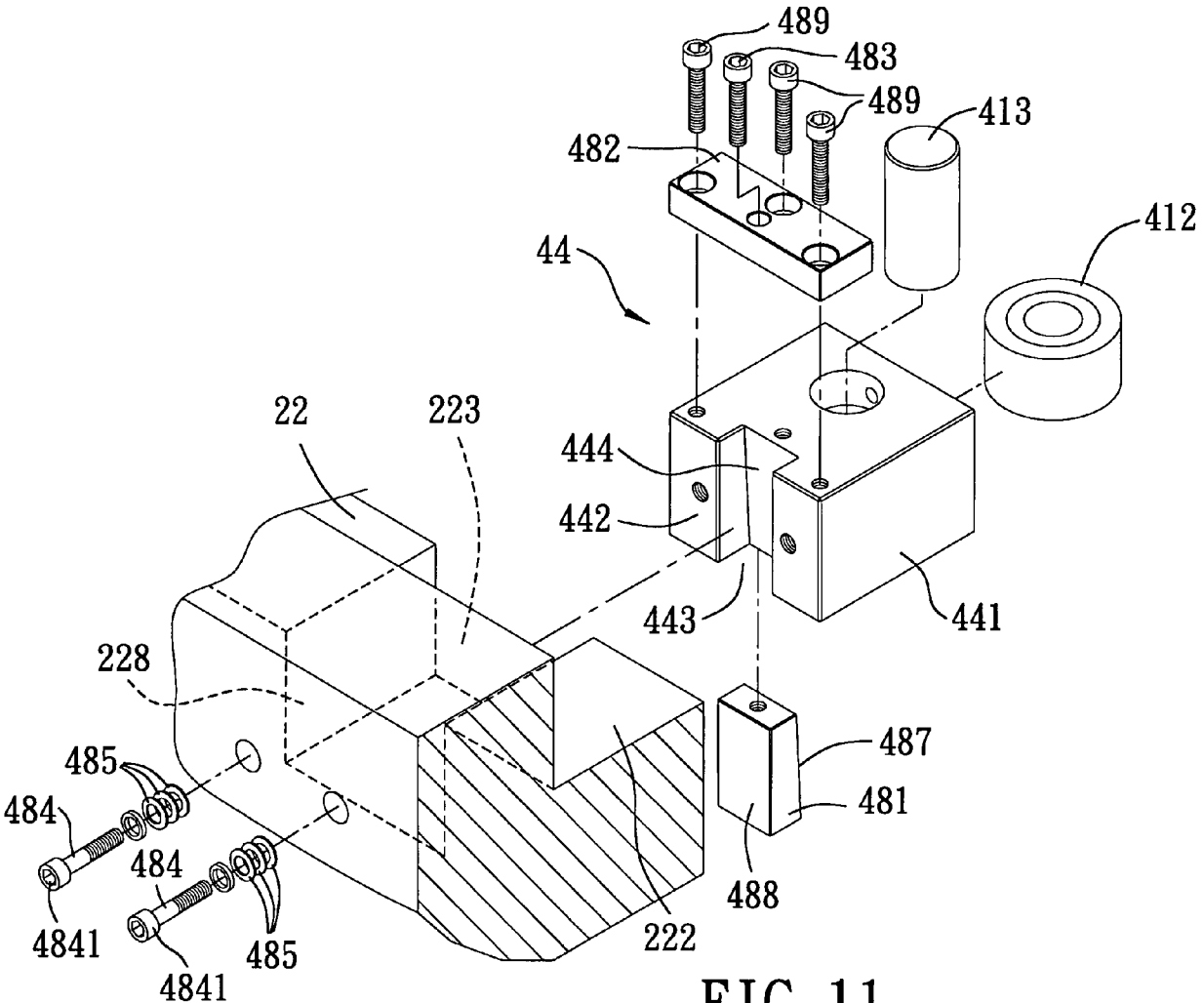
FIG. 11 is an exploded view showing a second rolling device according to the second preferred embodiment of the present invention.
Figure 12:
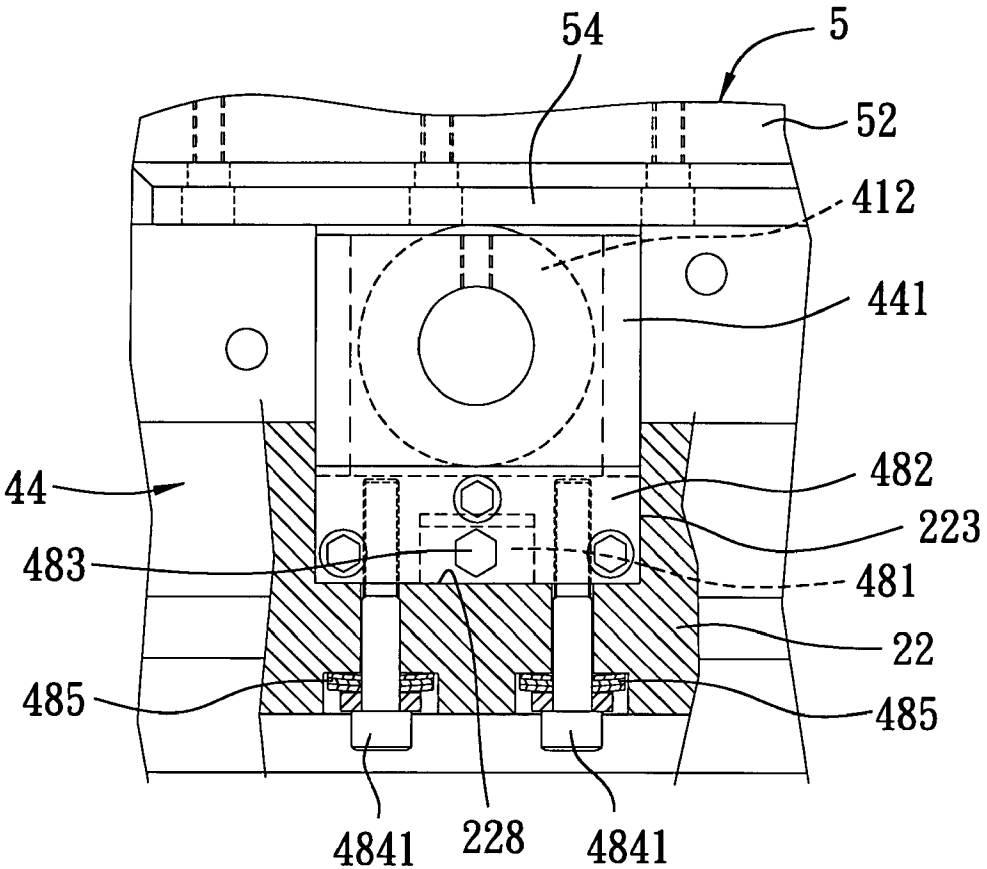
FIG. 12 is a sectional plan view showing the second rolling device of the second preferred embodiment.
Figure 13:
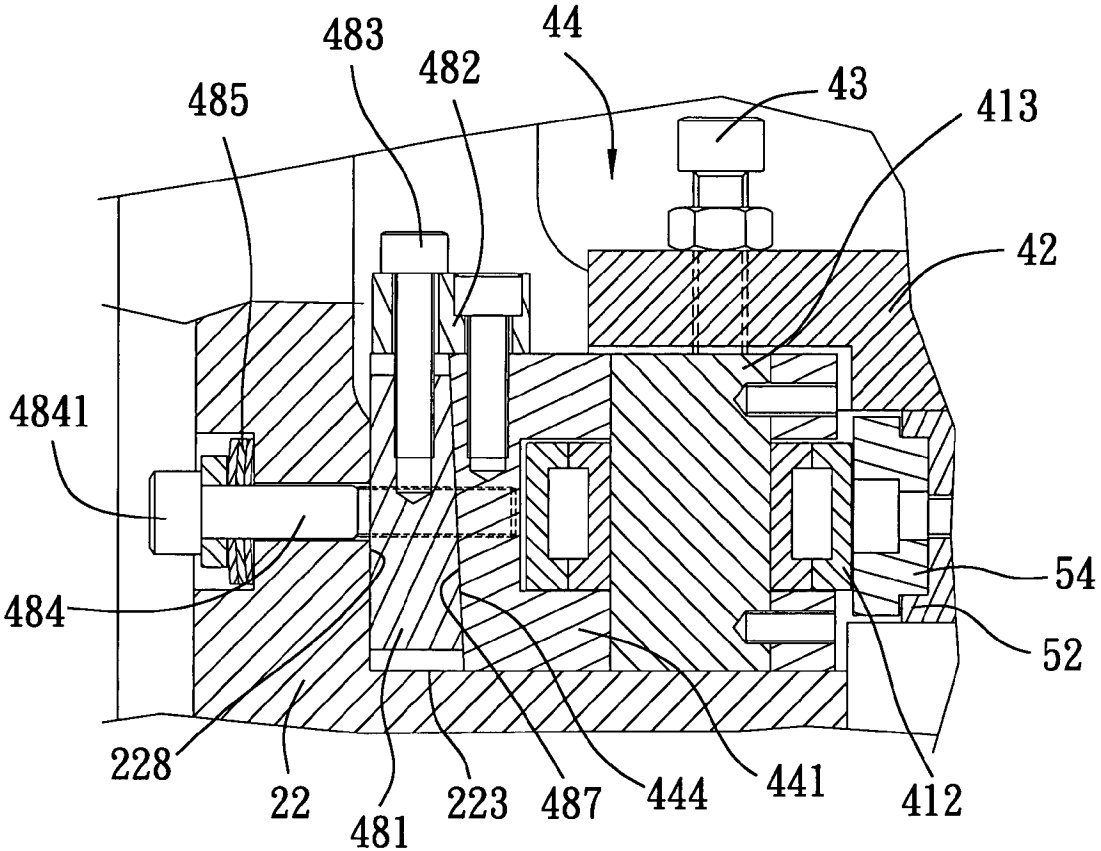
FIG. 13 is a sectional elevation view showing the second rolling device of the second preferred embodiment.

Referring to FIGS. 11, 12 and 13, according to the second preferred embodiment of the present invention, the second rolling device 4 may include a second roller unit 44. The second roller unit 44 differs from the second roller unit 41 of the first preferred embodiment in having a second roller holder 441, a second packing plate 481, and a retaining plate 482.

The second roller holder 441 has a holder lateral wall 442 facing the cavity bounding wall part 228 of the sidewall 22. The holder lateral wall 442 has a slide groove 443 that extends in a direction from a top end to a bottom end of the second roller holder 441, and an inclined surface 444 facing the slide groove 443. The second packing plate 481 is inserted into the slide groove 443 and has one side 488 in contact with the cavity bounding wall part 228, and another side 487 opposite to the side 488 and contacting the inclined surface 444 of the holder lateral wall 442. The side 487 of the second packing plate 481 is inclined with respect to the side 488 and the cavity bounding wall part 228. The second packing plate 481 is slidable over the inclined surface 444 and along the slide groove 443 to move the second roller holder 441 in a direction substantially perpendicular to the cavity bounding wall part 228 so that the second roller holder 441 can be moved toward or away from the slide body 50 (see FIG. 2).

The retaining plate 482 is fixed to a top end of the second roller holder 441 above the second packing plate 481 by means of screws 489 so as to retain the second packing plate 481 in the slide groove 443. An adjustment screw 483 extends through the retaining plate 482 and is inserted threadedly into the second packing cavity bounding wall part 228 and are inserted threadedly into the second packing plate 481 and the holder lateral wall 442. A biasing member is associated with each fastening bolt 484 to bias the second roller holder 441 to move in a direction toward the cavity bounding wall part 228, or, away from the slide body 50. Each fastening bolt 484 has ahead 4841 extending outwardly of the cavity bounding wall part 228. The biasing member in this embodiment includes three spring discs 485 disposed around each fastening blot 484 between the head 4841 and the cavity bounding wall part 228.

When the adjustment screw 483 is turned relative to the retaining plate 482, the second packing plate 481 can be moved upward or downward. When the second packing plate 481 is moved upward, the second roller holder 441 is pushed toward the slide body 50 so that the position of the second roller 412 is adjusted. When the second packing plate 481 is moved downward, the second roller holder 411 is moved back by the biasing action of the spring discs 485 in a direction away from the slide body 50.

Figure 14:
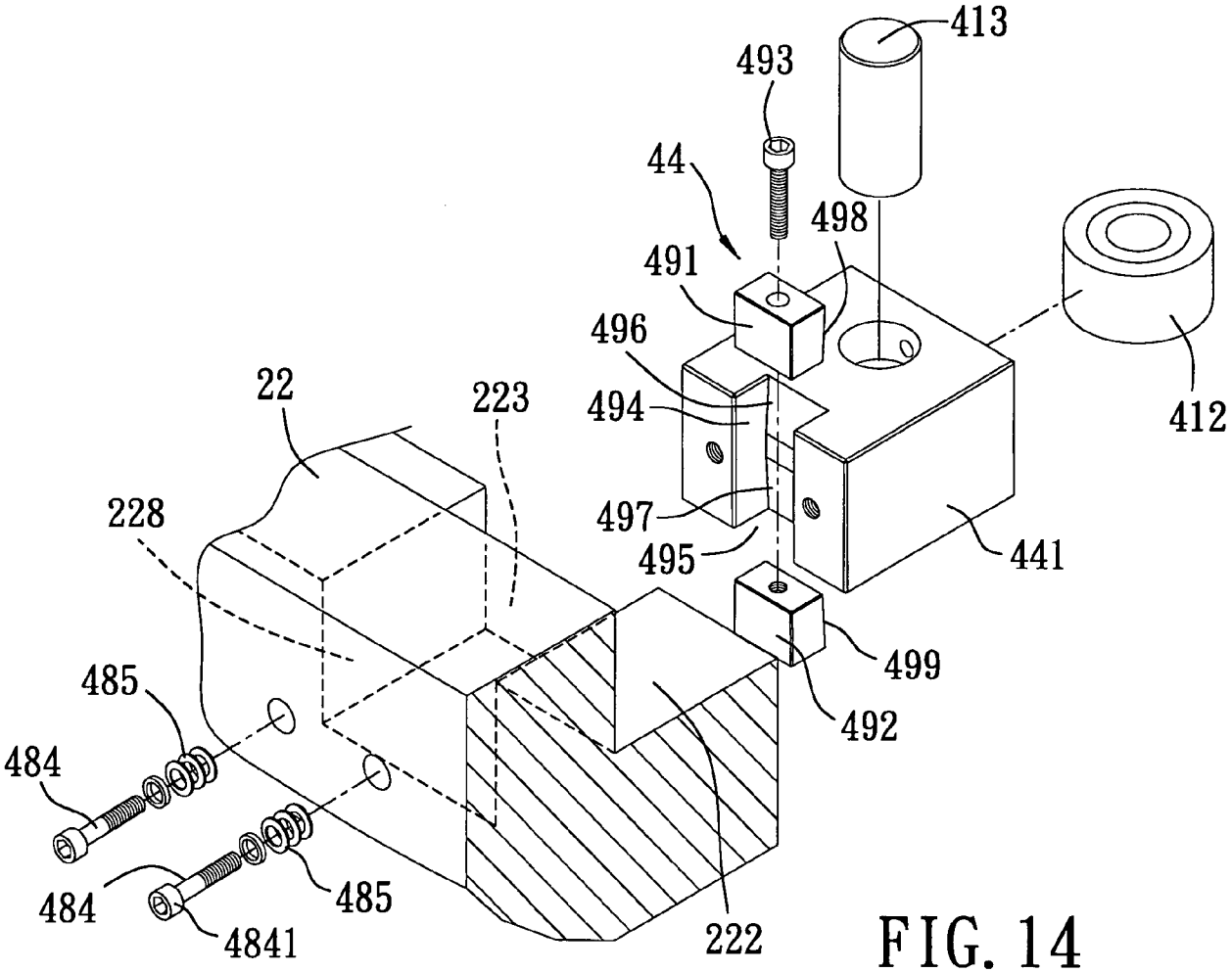
FIG. 14 is an exploded view showing a second rolling device according to the third preferred embodiment.
Figure 15:
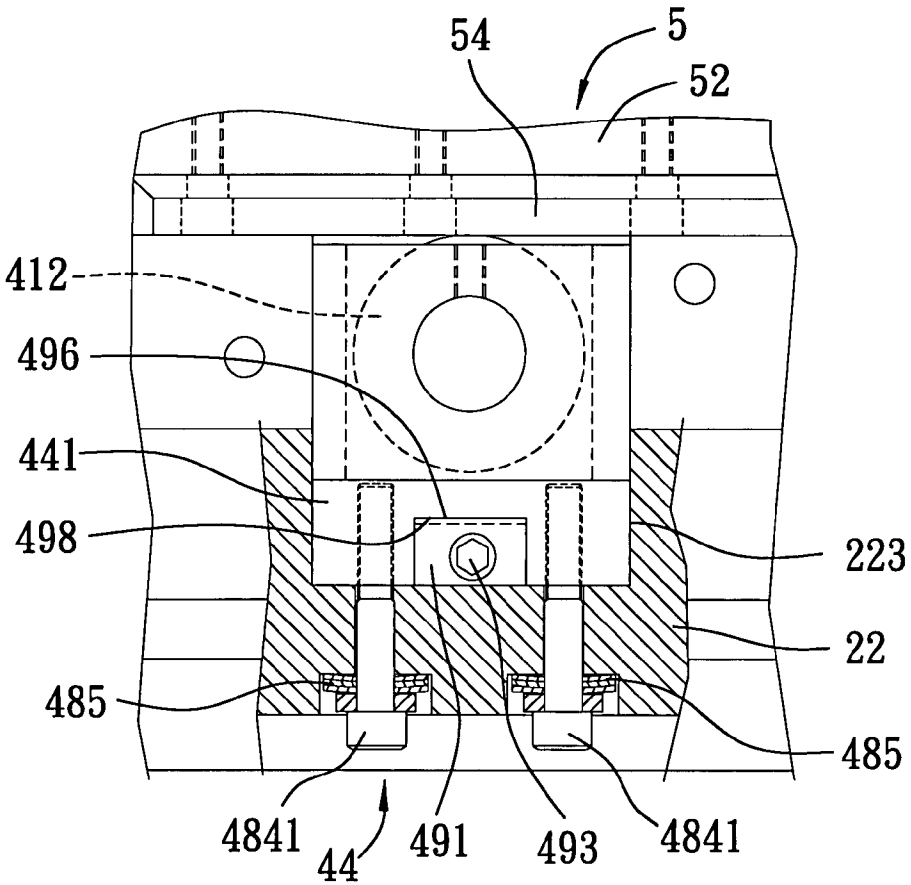
FIG. 15 is a sectional plan view showing the second rolling device of the third preferred embodiment.
Figure 16:
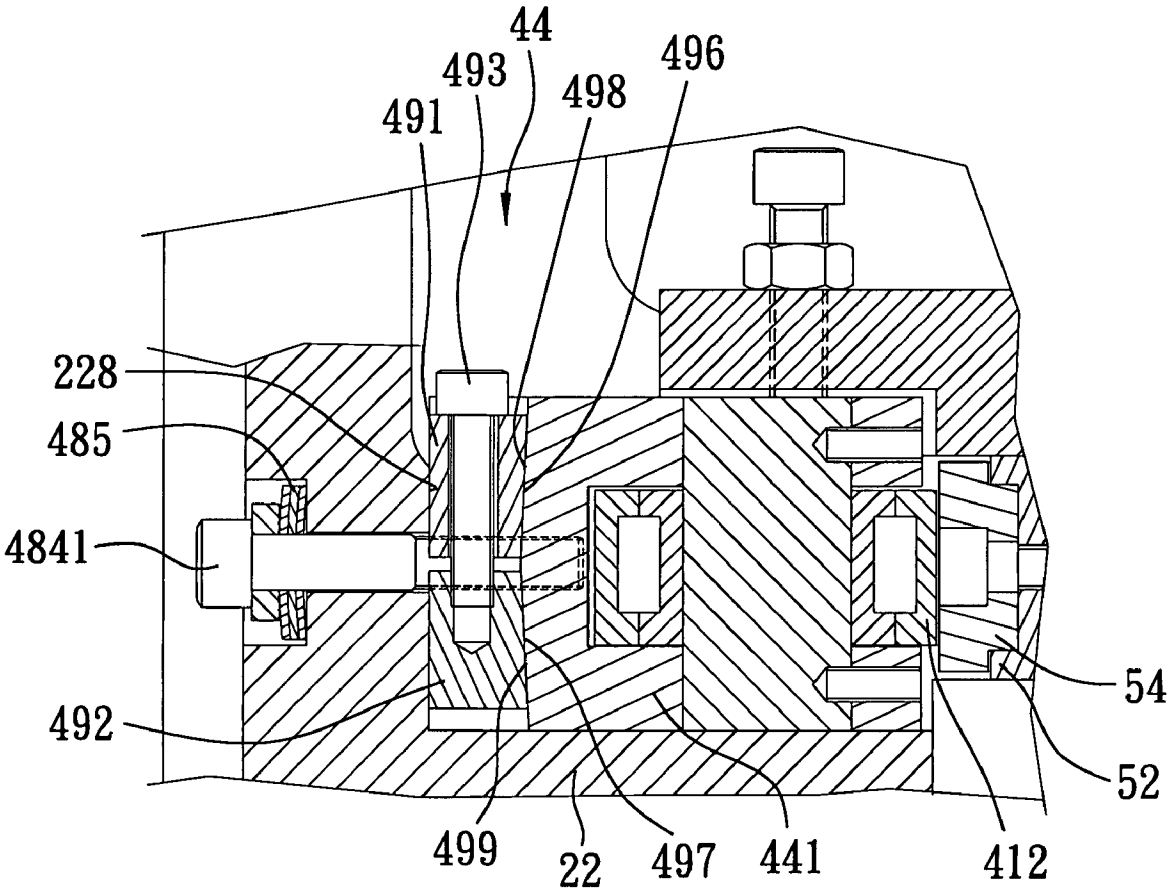
FIG. 16 is a sectional elevation view showing the second rolling device of the third preferred embodiment.

Referring to FIGS. 14, 15 and 16, according to the third preferred embodiment of the present invention, upper and lower plate portions 491 and 492 may be used in place of the second packing plate 481 of the second preferred embodiment, upper and lower groove portions 494, 495 may be used in place of the slide groove 443 494, 495 may be used in place of the slide groove 443 of the second preferred embodiment, and upper and lower surface portions 496, 497 may be used in place of the inclined surface 444 in the second preferred embodiment.

Each of the upper and lower plate portions 491, 492 is inserted into one of the upper and lower groove portions 494, 495, and has two opposite sides respectively contacting the cavity bounding wall part 228 and one of the upper and lower surface portions 496, 497. One inclined side 498 of the upper plate portion 491 contacts the upper surface portion 496, whereas one inclined side 499 of the lower plate portion 492 contacts the lower surface portion 497. The upper and lower surface portions 496, 497 are inclined in two different directions so that the upper groove portion 494 tapers downward and the lower groove portion 495 tapers upward. Likewise, the upper plate portion 491 tapers downward, and the lower plate portion 492 tapers upward. An adjustment screw 493 passes through the upper plate portion 491 and is inserted into the lower plate portion 492. When the adjustment screw 493 is rotated, the lower plate portion 492 can be moved upward or downward so that the second roller holder 441 can be moved toward or away from the slide body 50.

Due to the use of the first and second rolling devices 3 and 4 which are provided respectively near the front and rear ends 229, 227 of the support 2, the slide body 50 of the male die assembly 5 can be slid stably without positional deviation, thereby permitting the male die assembly 5 to operate at a high speed while still producing good quality products.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A forging machine comprising:

a support including a bottom wall, two sidewalls extending upward from left and right sides of said bottom wall, and two track plates attached to said sidewalls, respectively, each of said sidewalls having a lower portion to which a corresponding one of said track plates is attached, and an upper portion extending above said lower portion, said bottom wall, said sidewalls, and said track plates cooperatively confining a receiving space;

two first rolling devices respectively mounted on said track plates proximate to a front end of said support, and having first rollers exposed from said track plates, respectively;

two second rolling devices respectively mounted on said upper portions proximate to a rear end of said support, and having second rollers exposed from said upper portions, respectively; and a die assembly having a slide body slidably mounted within said receiving space, said slide body including left and right lower side faces respectively contacting said first rollers, and left and right upper flanges that extend respectively above said left and right lower side faces and that are seated slidably and respectively on top of said track plates to contact said second rollers.

2. The forging machine of claim 1, wherein each of said left and right lower side faces has a first steel plate placed in contact with a respective one of said first rollers.

3. The forging machine of claim 1, wherein each of said left and right upper flanges has a second steel plate placed in contact with a respective one of said second rollers.

4. The forging machine of claim 1, wherein said upper portion of each of said sidewalls has a cavity, each of said second roller devices further having a second roller holder disposed inside said cavity and holding a respective one of said second rollers.

5. The forging machine of claim 4, wherein said upper portion of each of said sidewalls is stepped, and further has a sidewall shoulder face extending substantially horizontally and longitudinally above said top end of a corresponding one of said track plates, and a sidewall inner face extending substantially vertically downward from said sidewall shoulder face and facing said slide body, said cavity opening at said sidewall shoulder face and said sidewall inner face.

6. The forging machine of claim 4, wherein said upper portion of each of said sidewalls further has a cavity bounding wall part extending at one side of said second roller holder opposite to said slide body, each of said second rolling devices further including a second packing plate inserted in between said cavity bounding wall part and said second roller holder.

7. The forging machine of claim 6, wherein said second roller holder further has a holder lateral wall facing said cavity bounding wall part and having an inclined surface, said second packing plate being disposed between said cavity bounding wall part and said inclined surface, said second packing plate having two opposite sides one of which contacts said cavity bounding wall part, and the other one of which is inclined with respect to said cavity bounding wall part and contacts said inclined surface, said second packing plate being slidable over said inclined surface to move said second roller holder in a direction substantially perpendicular to said cavity bounding wall part.

8. The forging machine of claim 7, wherein said holder lateral wall further has a slide groove opposite to said cavity bounding wall part, said inclined surface being formed in said slide groove, said second packing plate being inserted into said slide groove.

9. The forging machine of claim 8, wherein each of said second rolling devices further includes an adjustment screw inserted into said second packing plate so as to move linearly said second packing plate within said slide groove.

10. The forging machine of claim 7, wherein each of said second rolling devices further includes a biasing member that biases said second roller holder to move in a direction toward said cavity bounding wall part.

11. The forging machine of claim 10, wherein each of said second rolling device further includes a fastening bolt extending through said cavity bounding wall part and inserted threadedly into said second roller holder, said fastening bolt having a head extending outwardly of said cavity bounding wall part, said biasing member having a plurality of spring discs disposed around said fastening bolt and between said head and said cavity bounding wall part.

12. The forging machine of claim 8, wherein said inclined surface is divided into an upper surface portion and a lower surface portion, said upper and lower surface portions being inclined in two different directions, said slide groove being divided into an upper groove portion that has said upper surface portion and that tapers downward, and a lower groove portion that has said lower surface portion and that tapers upward, said second packing plate being divided into upper and lower plate portions which are inserted respectively into said upper and lower groove portions, said upper plate portion tapering downward, said lower plate portion tapering upward.

13. The forging machine of claim 12, wherein each of said second rolling devices further includes an adjustment screw passing through said upper plate portion and inserted threadedly into said lower plate portion.

* * * * *